US006307205B1

(12) United States Patent
Tsuno

(10) Patent No.: US 6,307,205 B1
(45) Date of Patent: Oct. 23, 2001

(54) OMEGA ENERGY FILTER

(75) Inventor: Katsushige Tsuno, Tokyo (JP)

(73) Assignee: JEOL Ltd., Tokyo (JP)

( * ) Notice: Subject to any disclaimer, the term of this patent is extended or adjusted under 35 U.S.C. 154(b) by 0 days.

(21) Appl. No.: 09/264,913

(22) Filed: Mar. 9, 1999

(30) Foreign Application Priority Data

Mar. 9, 1998 (JP) ..... 10-056324

(51) Int. Cl.[7] ..... G21K 1/08; H01J 3/14; H01J 3/26; H01J 49/42

(52) U.S. Cl. ..... 250/396 ML; 250/307; 250/308; 250/310

(58) Field of Search ..... 250/396 ML, 307, 250/310

(56) References Cited

PUBLICATIONS

"Adaptation of a Magnetic Filtering Device on a One Megavolt Electron Microscope", G. Zanchi et al., *Optik*, 43 (1975) No. 5, 495–501.

"High–Resolution imaging magnetic energy filters with simple structure", S.Lanio, Optik, 73, No.3 (1986) pp. 99–107.*

* cited by examiner

*Primary Examiner*—Jack Berman
*Assistant Examiner*—K Fernandez
(74) *Attorney, Agent, or Firm*—Webb Ziesenheim Logsdon Orkin & Hanson, P.C.

(57) ABSTRACT

There is disclosed an OMEGA energy filter comprising three magnetic field regions and producing small aberrations. The electron beam trajectory from the entrance window plane to the slit plane is continuously deflected into an omega-shaped form. Three magnetic field regions M1, M23, and M4 having deflection angles Φ, 2Φ, and Φ, respectively, are arranged in turn from the incident side. The deflection angle Φ is set such that 102°_. . . Φ_. . . 115°. The radius of curvature R3 of the beam in the magnetic field region having the deflection angle 2Φ is set less than the radius of curvature R4 of the beam in the magnetic field regions having the deflection angle Φ.

2 Claims, 8 Drawing Sheets

SLIT PLANE
PUPIL PLANE
PUPIL PLANE
EXIT PUPIL PLANE
ENTRANCE WINDOW PLANE
α,β
γ,δ
LL
SLIT PLANE
M1
M2
M3
M4
SYMMETRICAL PLANE

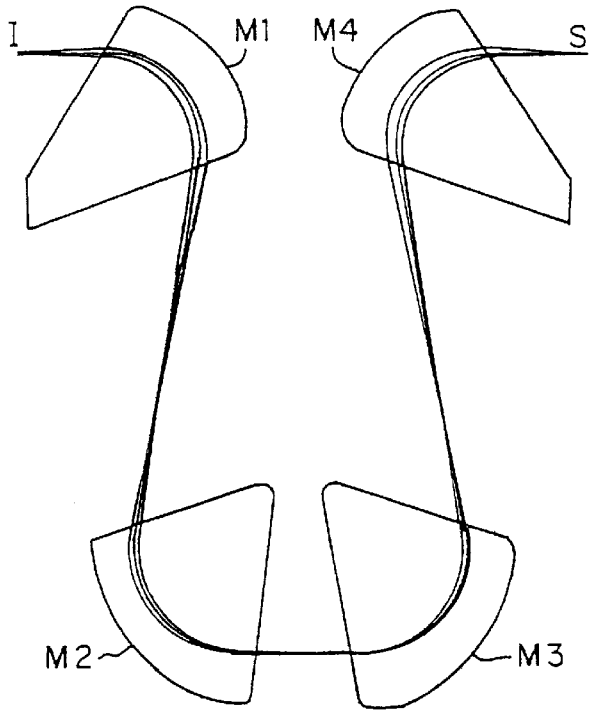
FIG. 11 A-TYPE OMEGA
PRIOR ART
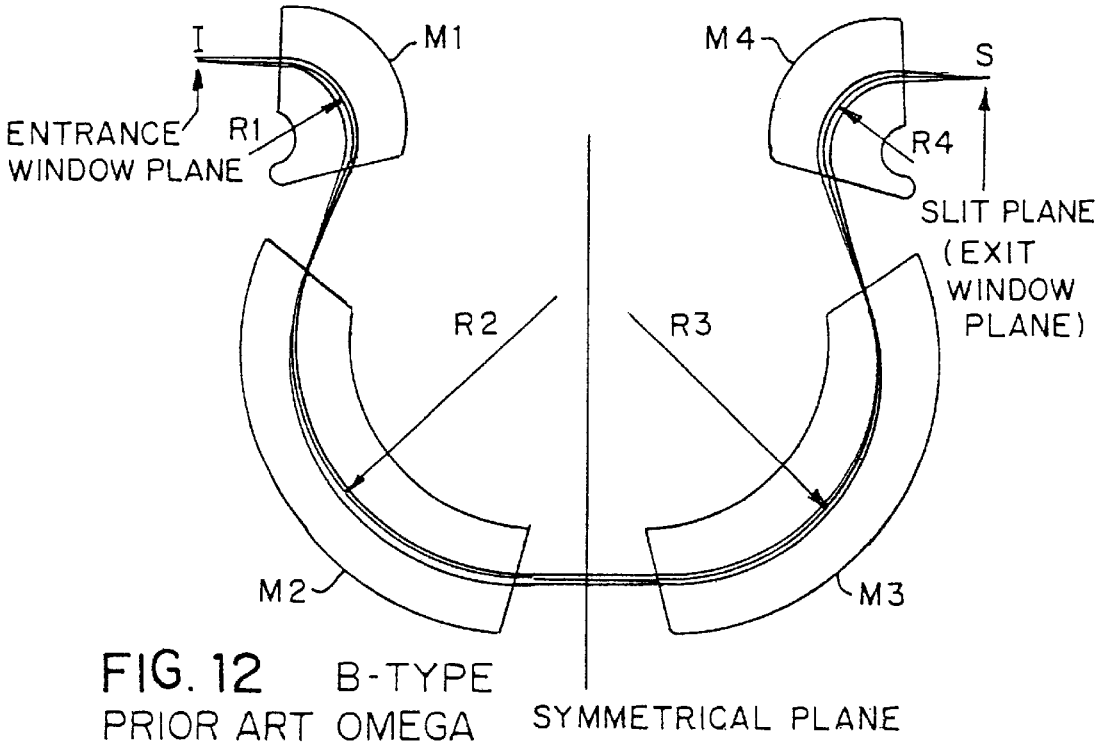
FIG. 12 B-TYPE OMEGA
PRIOR ART

FIG. 13(B) A-TYPE OMEGA
PRIOR ART

FIG. 14(B) B-TYPE OMEGA
PRIOR ART

OMEGA ENERGY FILTER

FIELD OF THE INVENTION

The present invention relates to a three-magnet OMEGA energy filter for continuously deflecting the trajectory of an electron beam from the incident aperture plane to the slit plane in an omega-shaped form.

DESCRIPTION OF THE PRIOR ART

FIG. 10 shows an example of the structure of an electron microscope having electron optics incorporating an OMEGA energy filter. FIG. 11 illustrates the structure of the A-type OMEGA energy filter. FIG. 12 illustrates the structure of the B-type OMEGA energy filter. FIGS. 13(A) and 13(B) illustrate the fundamental trajectory of the A-type OMEGA energy filter. FIGS. 14(A) and 14(B) illustrate the fundamental trajectory of the B-type OMEGA energy filter.

As shown in FIG. 10, the electron microscope having electron optics incorporating the OMEGA energy filter has an electron gun 11 emitting an electron beam that is directed to a specimen 14 through condenser lenses 12 and an objective lens 13. An observable image of the specimen 14 is projected onto a fluorescent screen 20 via an intermediate lens 15, an entrance aperture 16, the OMEGA energy filter 17, a slit 18, and a projector lens 19. In this OMEGA-type energy filter, four magnetic field regions M1, M2, M3, and M4, where the beam has radii of curvature R1, R2, R3, and R4, respectively, are arranged to form an omega-shaped trajectory. The electron beam is passed through these magnetic field regions in turn such that the outgoing beam is aligned with the incident beam. FIGS. 11 and 12 show two examples of the shape of the magnetic polepieces and electron trajectory, including the optical axis.

In this way, an instrument having an OMEGA energy filter inserted in or behind the imaging lens system of a transmission electron microscope for magnifying and projecting an image of the specimen 14 onto the fluorescent screen 20 has received popular acceptance as an apparatus for electron spectroscopic imaging (ESI) in recent years. In OMEGA energy filters, ALPHA energy filters, and so on, the optical axis of the incident beam is in line with the optical axis of the outgoing beam. Therefore, such an OMEGA energy filter is inserted in the center of the imaging lens system and is called an in-column ESI instrument.

A filter in which a single-sector magnet is combined with a multipolar corrector is available. In this filter, the optical axis of the outgoing beam makes an angle of about 90° to the incident beam. Therefore, this filter is not inserted in the center of the imaging lens system but behind it, i.e., behind the microscope column. Hence, this filter is called a post-column filter.

An OMEGA energy filter is a typical one of in-column filters. The prototype of this filter was manufactured by combining a magnetic field prism, an electrostatic mirror, and another magnetic field prism to form an in-column filter (originally known as the Castain-Henry filter) and replacing the electrostatic mirror by a magnetic field prism, so that all the deflecting elements were made of magnetic fields. This filter was developed in the 1970s in France and consists of three magnetic field regions. Then, aberration theory of filters has been investigated in Germany. It has been found that use of four magnetic field regions is more advantageous than use of three magnetic field regions. Subsequent research has been conducted into systems using four magnetic field regions.

In a sector-shaped magnet having a uniform magnetic field, the beam is focused in a direction x parallel to the plane of the magnetic polepieces in which energy dispersion takes place. However, no focusing action occurs in the direction of the magnetic field y. Accordingly, in the case of an OMEGA energy filter, the end surfaces of the magnetic polepieces are tilted to produce a quadrupole lens action, which focuses the beam in the direction of the magnetic field. The two examples shown in FIGS. 11 and 12 are designed under different optical conditions. The geometry of FIG. 11 is called type A in which three focusing actions take place in the direction x parallel to the plane of the magnetic polepieces and also in the direction of magnetic field y. The geometry of FIG. 12 is called type B in which three focusing actions take place in the direction x parallel to the plane of the magnetic polepieces and two focusing actions occur in the direction of the magnetic field y. Their different in fundamental optics can be seen from the trajectory diagrams of the types A and B shown in FIGS. 13(A), 13(B), 14(A) and 14(B), where the optical axis is drawn as a straight line.

In these trajectory diagrams, both trajectories $x_\alpha$ and $y_\beta$ are trajectories of an image finally focused onto the fluorescent screen 20. A detector, such as a CCD detector, may be mounted instead of the fluorescent screen 20. On the other hand, $x_\gamma$ and $y_\delta$ are focused onto the entrance window in the filter by the previous stage of lens. After passage through the filter, this dispersion takes place on the trajectory focused onto the slit 18. This slit 18 serves to cut off beams of other energies except for a part of the dispersed beam. The image on the fluorescent screen 20 or detector is formed by beams having an energy range passed through the slit. If the dispersion is left, a blurring will take place. Therefore, the dispersion must disappear on the pupil plane, which is called the achromatic condition. The OMEGA energy filter has a great feature that the trajectory is made symmetrical with respect to the center plane, canceling out the aperture aberration on the pupil plane and distortions.

In the OMEGA energy filter, in order to make some second-order aberrations zero and to reduce the remaining aberrations, the plane between the second magnetic field region M2 and the third magnetic field region M3 is used as a symmetrical plane (center plane). Thus, the beam trajectories before and after the symmetrical plane are rendered symmetrical. In particular, let LL be the distance from the exit pupil plane to the slit plane. The entrance pupil plane of the incident beam is adjusted to be at a distance of LL from the entrance window plane. Under these conditions, types A and B differ on the trajectory in the y-direction (in the direction of the magnetic field) as follows. With the type A, relations $y_\beta=0$ and $y_\delta'=0$ hold on the symmetrical plane as shown in FIG. 13(A). With the type B, relations $y_\beta'=0$ and $y_\delta=0$ hold as shown in FIG. 14(A). Note that "'" indicates differentiation with respect to z, i.e., the gradient of the trajectory. In either type, the x-trajectory gives $x_\alpha=0$ and $x_\gamma'=0$ on the symmetrical plane under the same conditions for both beams.

If the initial conditions are selected in this way for the type A, $x_\gamma$ trajectory is focused three times and $y_\delta$ trajectory is focused three times, also, as shown in FIG. 13(B). For type B,$x_\gamma$ trajectory is focused three times but $Y_\delta$ trajectory is focused only twice as shown in FIG. 14(B). That is, the image is turned over. The presence of these two types of OMEGA energy filters has been known for many years.

In the OMEGA energy filter, in order to focus the $x_\gamma$ trajectory and the $y_\delta$ trajectory onto the slit plane and to focus the $x_\alpha$ and $y_\beta$ trajectories onto the pupil plane, four adjustment parameters are necessary in total. If all of these adjustments are made with the tilt angle of the end surfaces of the magnetic polepieces, it is convenient to utilize four end surfaces of the two magnets. Although there are four magnets, the symmetry about the center must be maintained. Therefore, once the shapes of two magnets are determined, the conditions for the remaining two magnets are automatically determined. This is the fundamental reason why four magnetic field regions are used.

An ALPHA energy filter is known as an in-column energy filter similar to an OMEGA energy filter. In this ALPHA energy filter, the first magnetic field region, the final magnetic field region, and the intermediate magnetic field regions have the same polarity. The total deflection angle achieved by all the magnetic field regions is 36°. On the other hand, in the OMEGA energy filter, the intermediate magnetic field regions are opposite in polarity to the first and final magnetic field regions and so the total deflection angle achieved by all the magnetic field regions is 0°. Furthermore, the ALPHA energy filter apparently has magnetic field regions fewer than those of the OMEGA energy filter by one, because the first and final magnetic field regions are common in the ALPHA energy filter. The ALPHA energy filter first proposed was a two-magnetic field region system in which the intermediate magnetic field region was not separated. Then, an ALPHA energy filter made of a three-magnetic field region system in which the intermediate magnetic field region was separated was proposed. However, the ALPHA energy filter in which the intermediate magnetic field region is not separated is used as well as an ALPHA energy filter consisting of a three-magnetic field region system, unlike the three-magnetic field region OMEGA energy filter that had a common intermediate magnetic field region and became obsolete.

We have reviewed the three-magnetic field region OMEGA energy filter that was historically forgotten having a common intermediate magnetic field region as described above, and have succeeded in fabricating a three-magnetic field region OMEGA energy filter having smaller aberrations.

SUMMARY OF THE INVENTION

It is an object of the present invention to provide an OMEGA energy filter comprising three magnetic field regions and having smaller aberrations than heretofore.

This object is achieved in accordance with the teachings of the present invention by an OMEGA energy filter in which the trajectory of an electron beam from its entrance window plane to its slit plane is continuously deflected into an omega-shaped form. This filter has a symmetrical plane vertical to a plane containing the trajectory of the electron beam. The filter has three magnetic field regions located in this order from the incident side of the filter. The electron beam is deflected through angles of Φ, 2Φ, and Φ by these magnetic field regions, respectively. The deflection angle Φ is selected such that 102°_. . .Φ_. . . 115°. The radius of curvature R3 of the beam in the magnetic field region producing the deflection angle 2Φ is set less thank the radius of curvature R4 of the beam in the magnetic field regions producing the deflection region Φ.

Other objects and features of the invention will appear in the course of the description thereof, which follows.

BRIEF DESCRIPTION OF THE DRAWINGS

FIG. 11 is a diagram of an OMEGA energy filter of type A, illustrating its structure;

FIG. 12 is a diagram of an OMEGA energy filter of type B, illustrating its structure;

FIGS. 13(A) and 13(B) are diagrams illustrating the fundamental trajectory in the OMEGA energy filter of type A; and FIGS. 14(A) and 14(B) are diagrams illustrating the fundamental trajectory in the OMEGA energy filter of type B.

DESCRIPTION OF THE PREFERRED EMBODIMENTS

Figure 1:
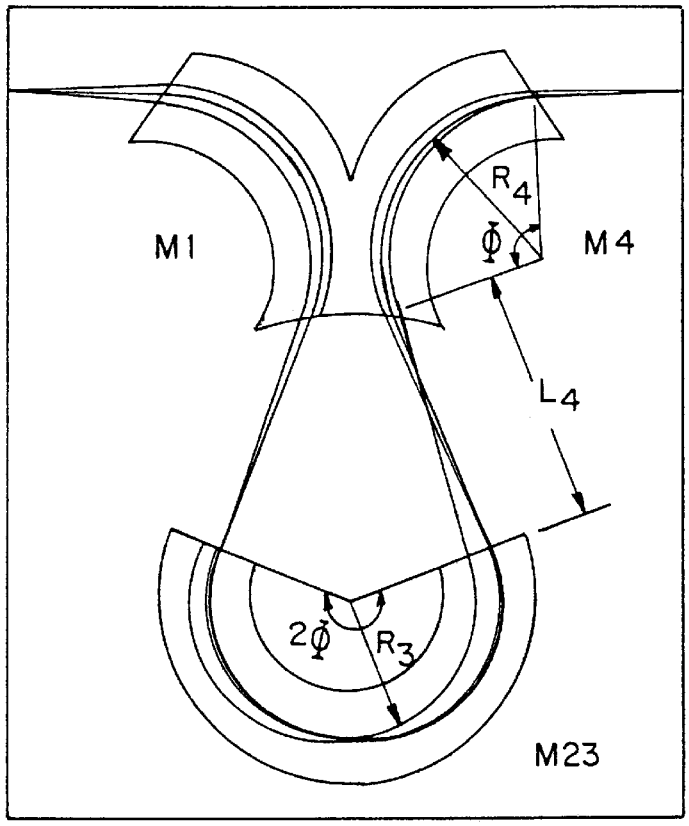
FIG. 1 is a diagram of an OMEGA energy filter in accordance with the present invention.
Figure 2:
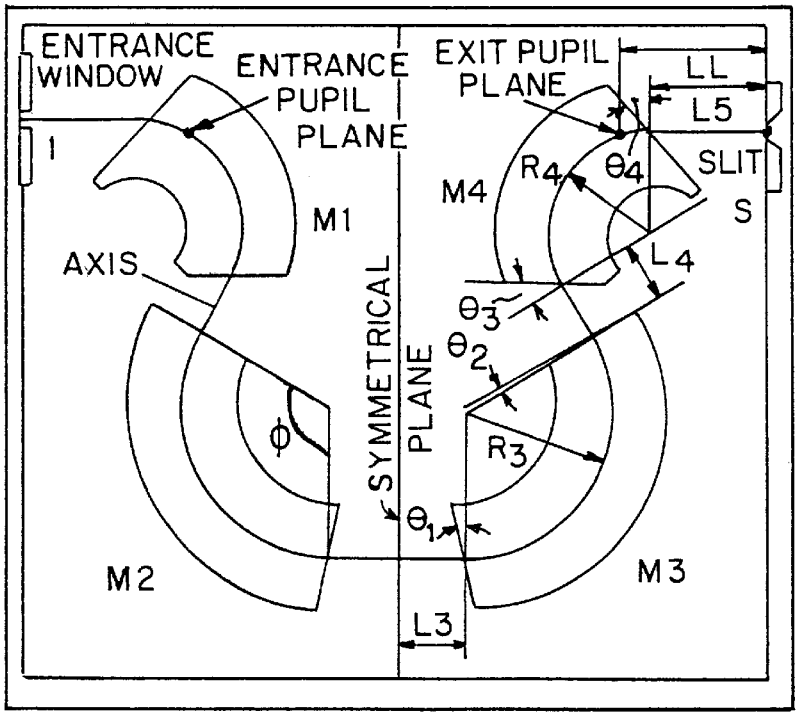
FIG. 2 PRIOR ART
FIG. 2 is a diagram illustrating parameters used in designing an OMEGA energy filter.
Figure 4:
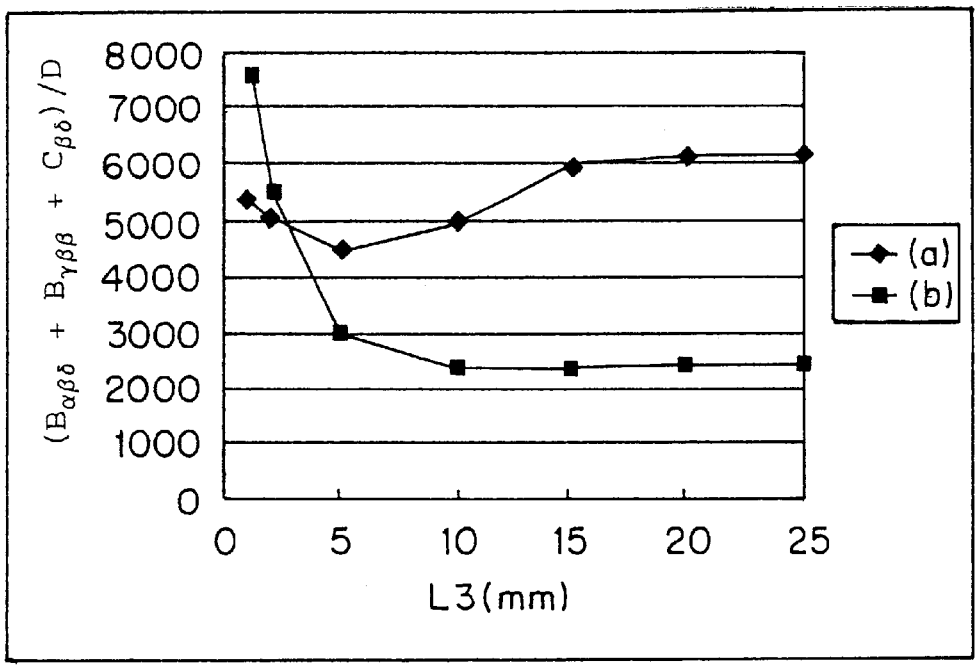
FIG. 4 is a diagram showing aberrations of two kinds of OMEGA energy filters having different drift lengths L3.
Figure 5:
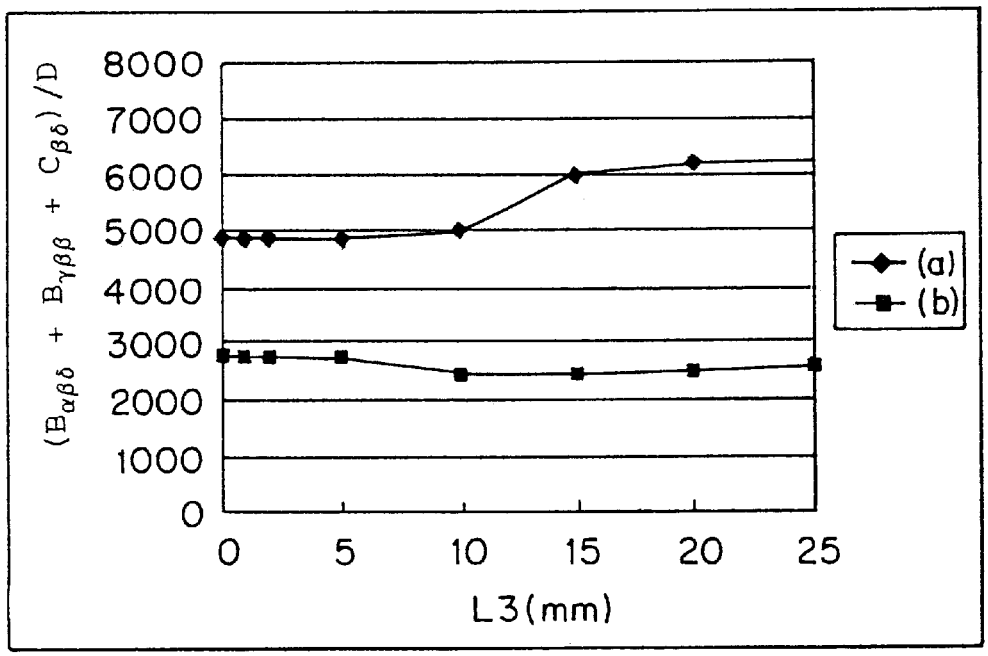
FIG. 5 is a diagram showing aberrations of OMEGA energy filters which are similar to the OMEGA energy filters illustrated in FIG. 4 except that only the end surfaces at drift length L3 are assumed to have no fringing field.

An OMEGA energy filter in accordance with the present invention is shown in FIG. 1. parameters used in designing an OMEGA energy filter are illustrated in FIG. 2. The relation between the exit pupil plane and the slit; plane of an OMEGA energy filter is illustrated in FIG. 3. In FIG. 4, aberrations of two kinds of OMEGA energy filters having different drift lengths L3 are shown. FIG. 5 is a diagram showing aberrations of OMEGA energy filters which are similar to the OMEGA energy filters illustrated in FIG. 4 except that only the end surfaces at drift length L3 are assumed to have no fringing field. In these figures, indicated by M1, M2, M3, and M4, are magnetic field regions. R3 and R4 indicate radii of curvature of an electron beam. L3 and L4 indicate the lengths of spaces.

Referring to FIG. 1, the magnetic field region M1 is located on the entrance side of the OMEGA energy filter and has a deflection angle of Φ. The magnetic field region M4 is located on the exit side and has a deflection angle of Φ. The magnetic field regions M1 and M4 are at symmetrical positions. The magnetic field region M23 is located midway between the magnetic field regions M1 and M4 and has a deflection angle of 2Φ. Strictly, the deflection angle should be denoted by −2Φ, taking account of the direction of deflection. However, the deflection angle will be simply indicated by 2Φ below. This intermediate magnetic field region M23 is obtained by combining two conventional magnetic field regions located on the side of the center plane (symmetrical plane) and reducing the distances (drift length) L3 from the center plane to the entrance end surfaces of these magnetic field regions down to zero. The OMEGA energy filter in accordance with the present invention has these three magnetic field regions having deflection angles of $\Phi$, $2\Phi$, and $\Phi$, respectively, as viewed from the entrance side. In this way, a three-magnetic field region OMEGA energy filter having a center plane vertical to a plane containing the electron beam trajectory is constructed.

Various parameters of the prior art OMEGA energy filter comprising a fomanetic field region system are illustrated in FIG. 2. R3 is the radius of curvature of the beam in the magnetic field region M3 located on the side of the center plane (symmetrical plane). $\theta_1$ is the angle that the entrance end surface of the magnet of the magnetic field region M3 makes. $\theta_2$ is the angle that the exit end surface of the magnet of the magnetic field region M3 makes. R4 is the radius of curvature of the beam in the magnetic field region M4 on the side of the slit. $\theta_3$ is the angle that the entrance end surface of the magnet of the magnetic field region M4 makes. $\theta_4$ is the angle that the exit end surface of the magnet of the magnetic field region M4 makes. $\Phi$ is the deflection angle of this magnetic field region M4. L3 is the distance (drift length) from the center plane to the entrance end surface of the magnet of the magnetic field region M3 on the side of the center plane. L4 is the distance from the exit end surface of the magnet of the magnetic field region M3 to the entrance end surface of the magnet of the magnetic field region M4. L5 is the distance from the exit end surface of the magnet of the magnetic field region M4 on the side of the slit to the slit plane. LL is the distance from the exit pupil plane to the slit plane.

The geometrical factors determining the fundamental optical characteristics of the OMEGA energy filters are the above-described ten factors, i.e., radii of curvature R3, R4, end surface tilt angles $\theta_1$, $\theta_2$, $\theta_3$, $\theta_4$, and the distances L3, L4, L5, LL. The distance between an actual end surface of each magnet and the effective end surface of the magnetic field distribution can be another parameter. However, this is neglected herein. Of these ten parameters, the end surface tilt angles $\theta_1$, $\theta_2$, $\theta_3$, and $\theta_4$ are used for adjustments to obtain astigmatic focus at the pupil plane and diffraction plane (i.e., the focal positions agree in the x- and y-directions). Other than the end surface tilt angles $\theta_1$, $\theta_2$, $\theta_3$, and $\theta_4$ described above, $\Phi$, R3, R4, L3, L4, and L5 can be adjusted as parameters as described later.

Figures 3A, 3B, 3C, 3D:
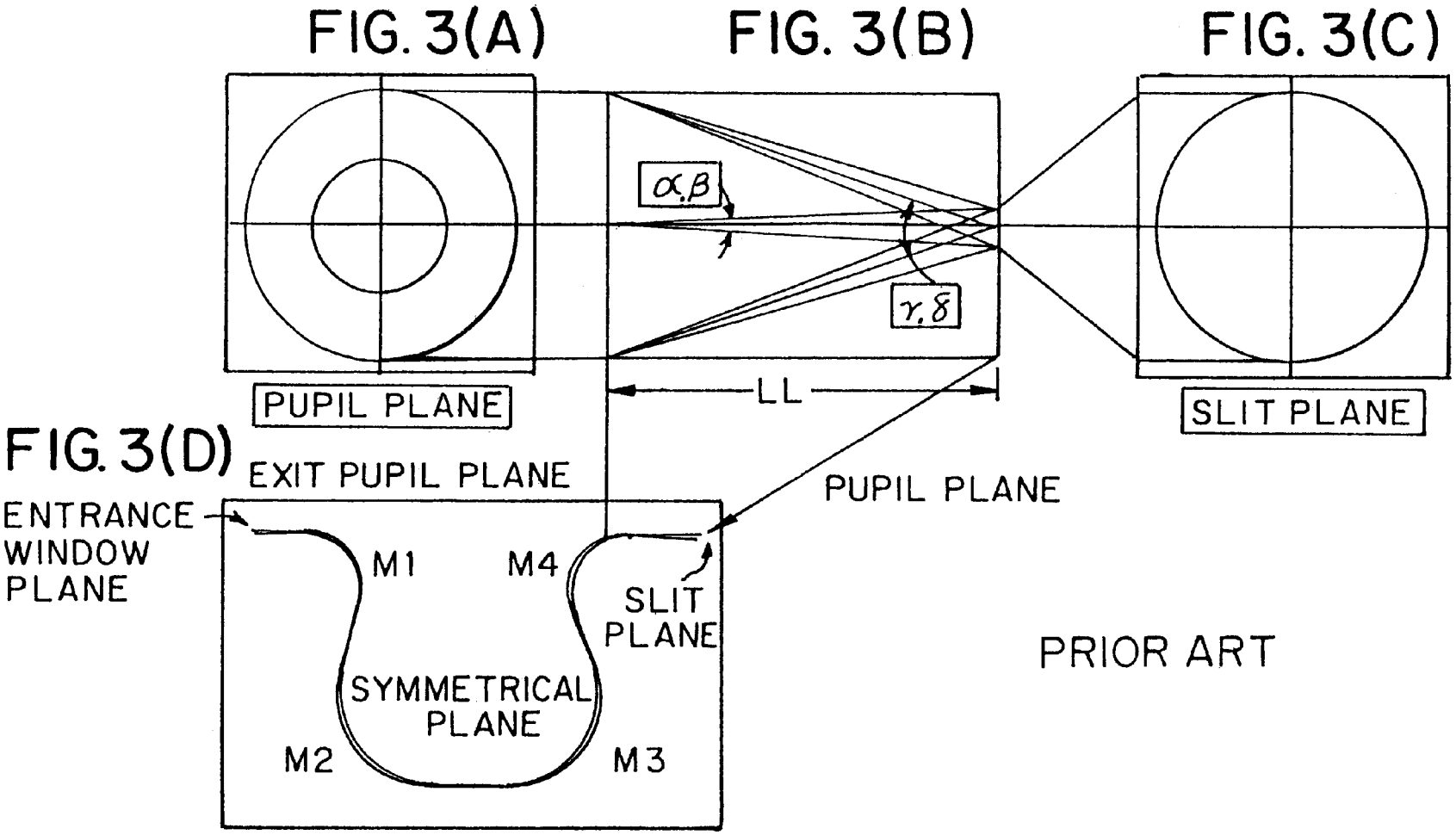
FIG. 3(D) PRIOR ART
FIGS. 3(A), 3(B), 3(C) and, 3(D) are diagrams and a table illustrating the relation between the pupil plane and the slit plane of an OMEGA energy filter.

The aberration-free image on the exit pupil plane of the OMEGA energy filter is shown in FIG. 3(A). The geometrical relations among the size of the aberration-free image on the exit pupil plane, the size of the aberration-free beam on the slit plane, the distance LL between both planes and angles $\alpha$, $\beta$, $\gamma$, and $\delta$ are shown in FIG. 3(B). The aberration-free beam on the slit plane is shown in FIG. 3(C). Aberrations $\Delta X_p$, $\Delta Y_p$, $\Delta X_s$, and $\Delta Y_s$ on both planes are expressed as shown below. Their magnitudes are dependent on aberration coefficients ($A_{\alpha\alpha\alpha}, \ldots, B_{\alpha\beta\beta}, \ldots, C_{\alpha\alpha}, \ldots$) and on the angles $\alpha$, $\beta$, $\gamma$, and $\delta$ that the exit pupil plane or the slit plane makes to the beam or the image. Note that $\alpha$ and $\gamma$ are angles to the x-axis, while $\alpha$ and $\delta$ are angles to the y-axis. The full size of the beam containing no aberrations on the slit plane subtends angles $\alpha$ and $\beta$. The full size of the image on the exit pupil plane subtends angles $\gamma$ and $\delta$. It is assumed that aberrations $\Delta X_p$ and $\Delta Y_p$ take place on the exit pupil plane and that aberrations $\Delta X_s$ and $\Delta Y_s$ occur on the slit plane.

The size of the beam at the specimen is limited by the objective aperture. The beam reaching the entrance window is also limited by the magnification of the intermediate lens. Therefore, where the magnification of the intermediate lens is low, the size of the beam is about: 5 $\mu$m at maximum. Where the intermediate lens is used with high magnification, the size is much smaller. This beam reaches the slit plane as it is through the filter. Therefore, the angles $\alpha$ and $\beta$ that the full size (at most: 5 $\mu$m) of the beam on the slit plane subtends are sufficiently small.

Assume that the distance LL is 100 mm. The angles $\alpha$ and $\beta$ that the aberration-free beam passing through this slit subtends are $0.005/100=5\times10^{-5}$ rad. On the other hand, as the full size of the aberration-free image on the exit pupil is estimated approximately 1 mm, the angles $\gamma$ and $\delta$ that the image on the exit pupil plane subtends are $1/100=10^{-2}$ rad. Hence, they differ by a factor of 200. Although the magnitude of an aberration is the product of an aberration coefficient and an angle, the magnitudes of the angles $\alpha$, $\beta$, $\gamma$, and $\delta$ differ widely. Consequently, certain ones of the aberration coefficients determining the amount of aberration are predominant.

It is known that the aberration coefficients that are affected greatly by the length L3 of the drift spaces on the opposite sides of the center plane (symmetrical plane) are $C_{\beta\delta}$, $B_{\alpha\beta\delta}$, and $B_{\gamma\beta\beta}$. Accordingly, we consider as follows.

The aberrations $\Delta X_p$, $\Delta Y_p$, $\Delta X_s$, and $\Delta Y_s$ are given below.

$$\Delta X_p=\underline{A_{\alpha\alpha\alpha}}\alpha^2+A_{\alpha\alpha\gamma}2\alpha\gamma+\underline{A_{\alpha\gamma\gamma}}\gamma^2+\underline{B_{\alpha\beta\beta}}\beta^2/2$$

$$+B_{\alpha\beta\delta}\beta\delta+\underline{B_{\alpha\delta\delta}}\delta^2/2+C_{\alpha\alpha}\alpha\chi+C_{\alpha\gamma}\gamma\chi+C_{\alpha\chi}\chi^2$$

$$\Delta Y_p=\underline{B_{\alpha\beta\beta}}\alpha\beta+B_{\alpha\beta\delta}\alpha\delta+B_{\gamma\beta\beta}\beta\gamma+\underline{B_{\gamma\beta\delta}}\gamma\delta+C_{\beta\beta}\beta\chi+C_{\beta\delta}\delta\chi$$

$$\Delta X_s=A_{\alpha\alpha\gamma}\alpha^2+\underline{A_{\alpha\gamma\gamma}}2\alpha\gamma+A_{\gamma\gamma\gamma}\gamma^2+B_{\gamma\beta\beta}\beta^2/2+B_{\gamma\beta\delta}\beta\delta+B_{\gamma\delta\delta}\delta^2/2+C_{\alpha\gamma}\alpha\chi+C_{\gamma\gamma}\gamma\chi+C_{\chi\gamma}\chi^2$$

$$\Delta Y_s=B_{\alpha\beta\delta}\alpha\beta+B_{\alpha\delta\delta}\alpha\delta+\underline{B_{\gamma\beta\delta}\beta\gamma}+B_{\gamma\delta\delta}\gamma\delta+C_{\beta\delta}\beta\chi+C_{\delta\delta}\delta\chi$$

where $\chi$ is a variation in the energy of the beam.

In the above equations, because of the symmetry of the filter, some of the underlined terms are zero and thus these are erased. Only terms associated with $C_{\beta\delta}$, $B_{\alpha\beta\delta}$, and $B_{\gamma\beta\beta}$ that are aberration coefficients greatly affected by the drift length L3 and the second-order terms of $\gamma$ and $\delta$ that are large parameters are left. Thus, we have $$\Delta X_p=\underline{B_{\alpha\beta\delta}}\beta\delta$$

$$\Delta Y_p=\underline{B_{\alpha\beta\delta}}\alpha\delta+\underline{B_{\gamma\beta\beta}}\beta\gamma+\underline{C_{\beta\delta}}\delta\chi$$

$$\Delta X_s=A_{\gamma\gamma\gamma}\gamma^2+\underline{B_{\gamma\beta\beta}}\beta^2/2+B_{\gamma\delta\delta}\delta^2/2$$

$$\Delta Y_s=\underline{B_{\alpha\beta\delta}}\alpha\beta+B_{\gamma\delta\delta}\gamma\delta+\underline{C_{\beta\delta}}\beta\chi$$

where the underlined coefficients are three aberration coefficients affected greatly by the drift length L3. The coefficients not underlined are two aberration coefficients $A_{\gamma\gamma\gamma}$ and $B_{\gamma\delta\delta}$ associated with the second-order terms of the large parameters $\gamma$ and $\delta$.

$\Delta Y_p$ of the above equation contains every aberration coefficient affected greatly by the drift length L3. The aberration sum ($B_{\alpha\gamma\delta}+B_{\gamma\beta\beta}+C_{\beta\delta}$) can be a measure in evaluating the aberrations of the filter where the drift length L3 is varied. Practically, the dispersion of the filter is denoted by D, and the ratio ($B_{\alpha\gamma\delta}+B_{\gamma\beta\beta}+C_{\beta\delta}$)/D can be regarded as one evaluation value and used.

In FIG. 4, the evaluation value ($B_{\alpha\beta\delta}+B_{\gamma\beta\beta}+C_{\beta\delta}$)/D is plotted against the drift length L3 for two kinds of OMEGA energy filters. This evaluation value tends to decrease with reducing the drift length L3. However, the evaluation value turns to increase at around L3<5 mm. That is, reducing the drift length L3 excessively increases the aberration. It is noted, however, that where the drift length L3 is set less than 5 mm, the fringing field distribution becomes sharp. That is, there is a possibility that a sharp fringing field increases the aberration.

For convenience, we calculated the aberrations under the assumption that only the end surface at L3 has no fringing field. As can be seen from FIG. 5, the aberrations hardly increased. In this case, L3=0 means that the magnetic field regions M2 and M3 are in contact. with each other and form the unitary magnetic field region M23. In consequence, the four-magnetic field region OMEGA energy filter has become a three-magnetic field region OMEGA energy filter. Furthermore, the three magnetic field regions can be substantially realized with two magnets by constructing the magnetic field regions M1 and M4 from a common magnet as shown in FIG. 1.

It can be concluded from the comparison that the four-magnetic field region system does not always produce weaker aberrations than the three-magnetic field region system. The four-magnetic field region system was selected in the 1970s. Since then, only four-magnetic field region systems have ever been investigated. This means that the method of discussing the design has problems.

As can be seen from FIG. 1, if the deflection angle Φ of the magnetic field regions M1 and M4 on the entrance side and on the exit side, respectively, is increased, or if the length L4 of the space between the magnetic polepieces of the magnetic field regions M23 and M4 is increased, the electron beam trajectory approaches the center plane (symmetrical plane). If the deflection angle or the length L4 is increased further, the trajectory passes into the opposite side of the center plane. In this case, the tilt angle of the end surface for focusing is reversed in direction and so a danger exists of the beam being incapable of focusing. To circumvent this undesirable situation, it is necessary to limit the length L4 of the space, the deflection angle Φ and the radius of curvature R3 of the beam. The limitation is given by $$R3/\tan(\Phi-90)>L4$$

For example, if the radius of curvature R3 ofthe beam through the magnetic field region M3 is selected to be 50 mm to obtain a practical dispersion of 1 μm/eV at; 200 kV, the maximum value of the length L4 of the space between the magnetic field regions is less than 235 mm where Φ=102° and less than 107 mm where Φ=115°.

A three-magnetic field region system like an OMEGA energy filter in accordance with the present; invention has only three magnetic polepiece end surfaces for the four necessary focusing actions as described above Therefore, all the parameters other than the magnetic polepiece end surfaces must be used for the focusing actions. We have already mentioned that Φ, R3, R4, L3, L4, and L5 other than the angles $\theta_1$, $\theta_2$, $\theta_3$, and $\theta_4$ can be adjusted as parameters. In the embodiment described thus far, the radius of curvature R3 or R4 of the beam through the magnetic field region is used as a parameter in designing the instrument. Of course, other parameters may also be used.

Figure 6:
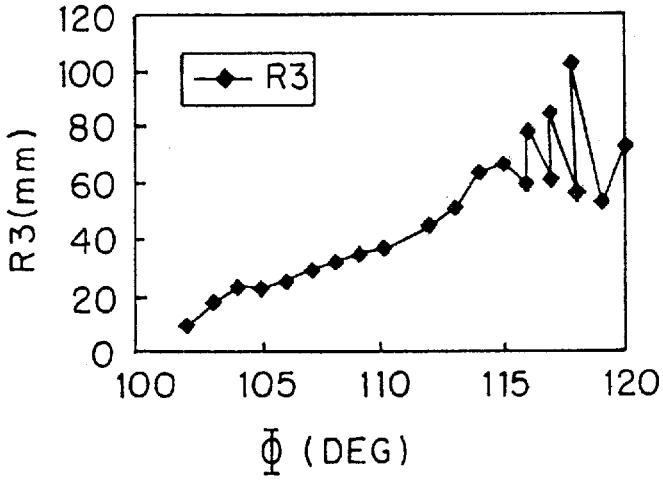
FIG. 6 is a graph in which the radius of curvature R3 given to an electron beam by a magnetic field, region M23 is plotted against the deflection angle Φ of the beam.
Figure 7:
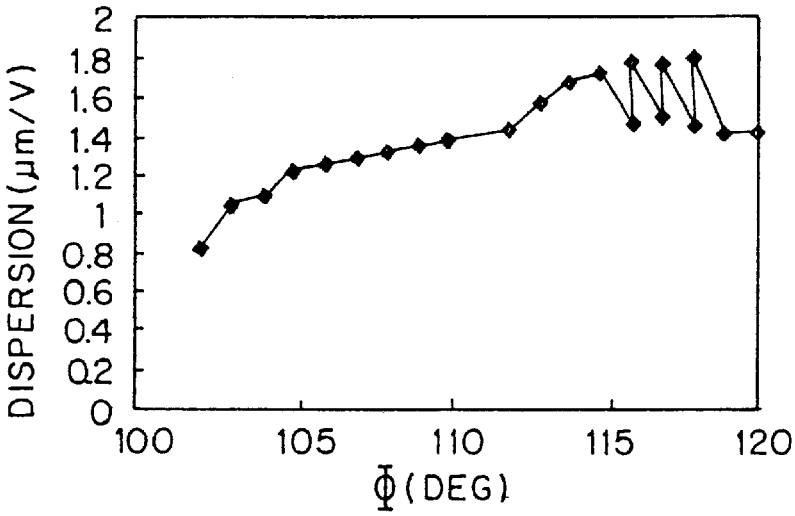
FIG. 7 is a graph in which the dispersion is plotted against the deflection angle Φ of the electron beam.

The optimum conditions under which a three-magnetic field region OMEGA energy filter in accordance with the present invention produce weaker aberrations as found in the manner described below. In FIG. 6, the radius of curvature R3 of the beam through the magnetic field region M3 is plotted against the deflection angle Φ of the electron beam. In FIG. 7, the dispersion D is plotted against the deflection angle Φ of the electron beam. The radius of curvature of the beam through the magnetic field region M4 is fixed at 65 mm at 200 kV. Where the radius of curvature is R3, other accelerating voltages can be found by multiplying R3 by $\{U^*/U^*(200\text{ kV})\}^{1/2}$. An example is noes given under the condition that the accelerating voltage is 200 kV. U* is a relativistically corrected accelerating voltage. U*(200 kV) is a relativistically corrected accelerating voltage at 200 kV. It can be seen from FIG. 6 that the radius of curvature R3 increases with increasing the deflection angle Φ. The deflection angle Φ spreads while vibrating beyond 115°, because it is considerably difficult to focus the beam in this region and thus the radius of curvature R3 swings violently. Accordingly, where R4=65 mm, the radius of curvature R3 needs to be approximately 60–70 mm or less. In this example, the deflection angle Φ is in the range from 102° to 120°. Outside this range, it has been difficult to focus the beam at small aberrations. In consequence, the deflection angle Φ is preferably from 102° to 115°. The results give filter geometries satisfying the following conditions:

(1) two aberration coefficients associated with the second-order terms of parameters γ and δ having large values:

$$A_{\gamma\gamma\gamma}, B_{\gamma\delta\delta}/2<500\text{nm}$$

(2) three aberration coefficients varying greatly according to the drift length L3:

$$B_{\alpha\beta\beta}, B_{\gamma\beta\beta}/2, C_{\beta\delta}<1000\text{ mm}$$

(3) dispersion: 1 μm/eV at 200 kV (4) end surface tilt angles: $0<\theta_2$, $\theta_3$, $\theta_4<45°$ As shown in FIG. 7, the dispersion increases with increasing the deflection angle Φ.

Figure 8:
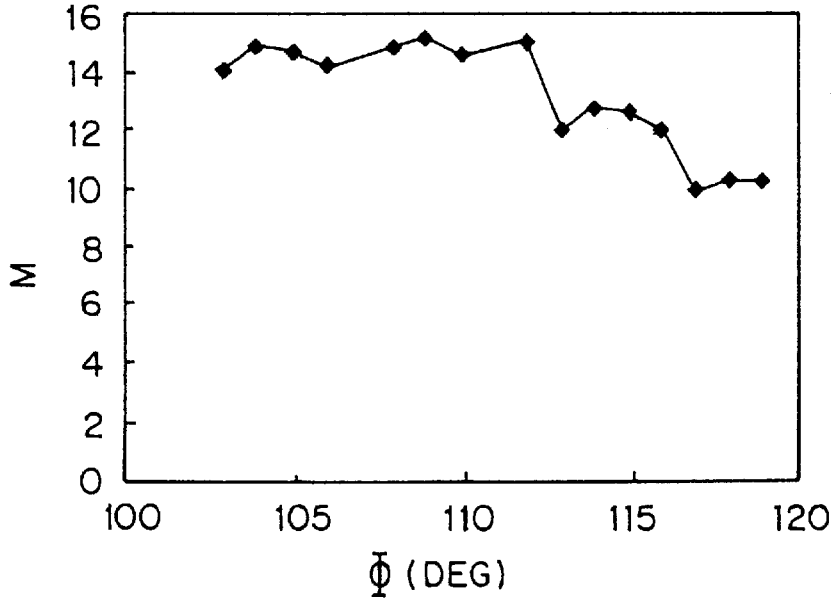
FIG. 8 is a graph in which a merit function M used to evaluate the performance of energy filters is plotted against the deflection angle Φ.
Figure 9:
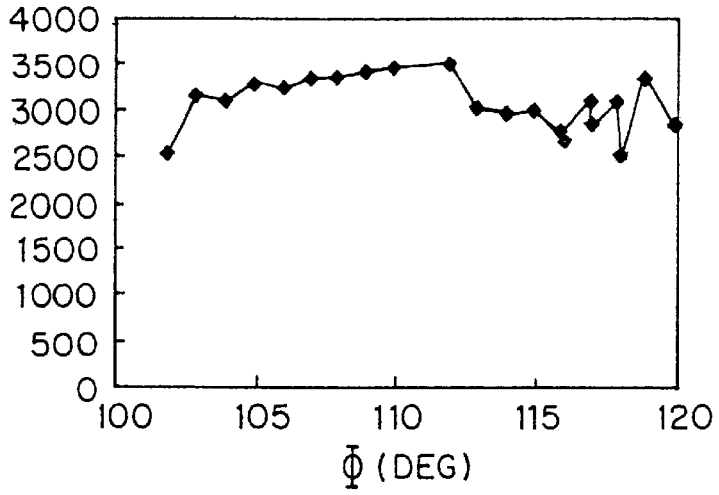
FIG. 9 is a graph showing an aberration sum ($B_{\alpha\beta\delta}+B_{\gamma\beta\beta}+C\beta\delta$) that is a measure of the amount of aberration on the pupil plane.
Figure 10:
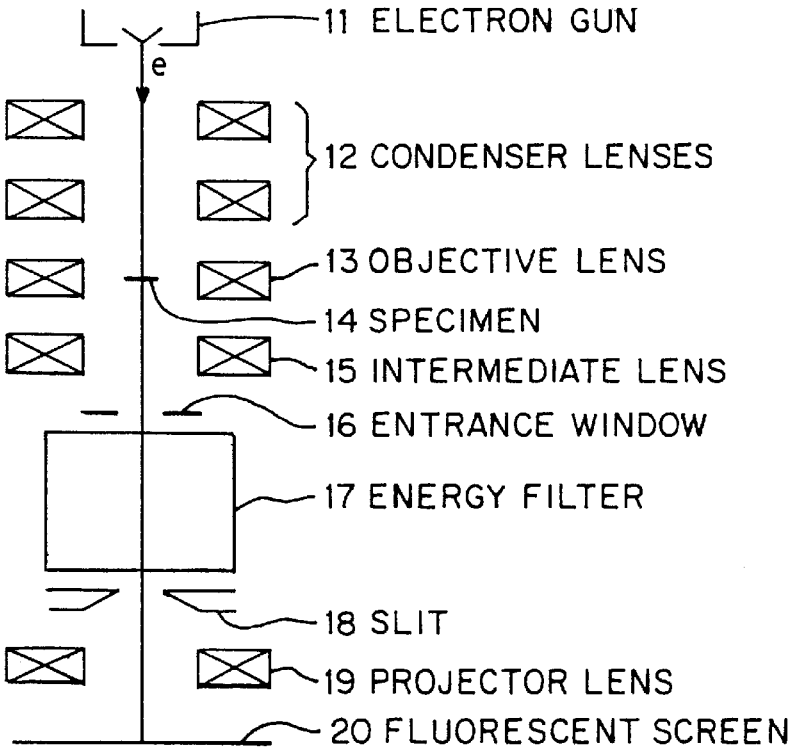
FIG. 10 PRIOR ART
FIG. 10 is a block diagram of an electron microscope having electron optics incorporating an OMEGAI energy filter.
Figure 13A:
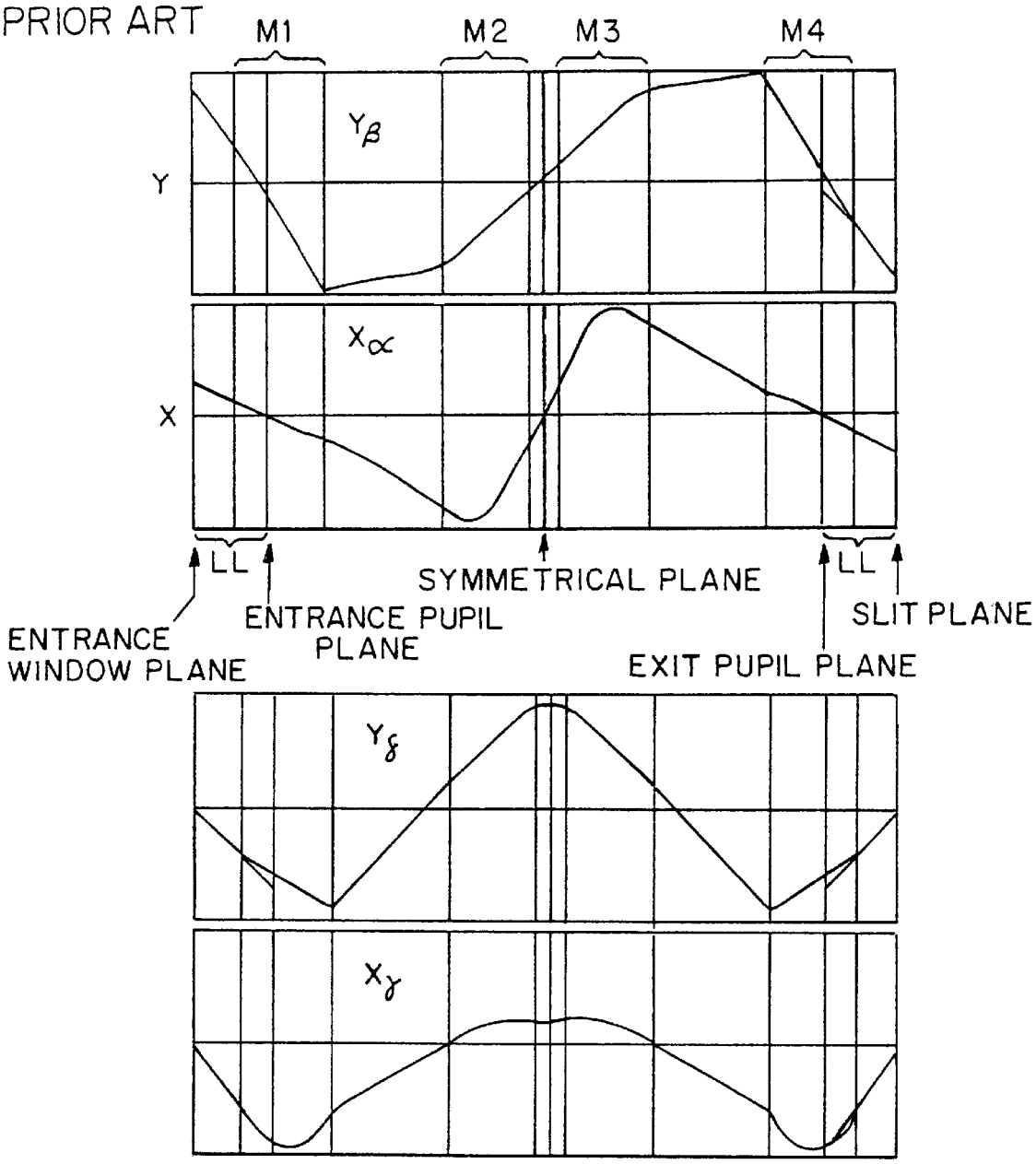
FIG. 13(A) PRIOR ART
Figure 14A:
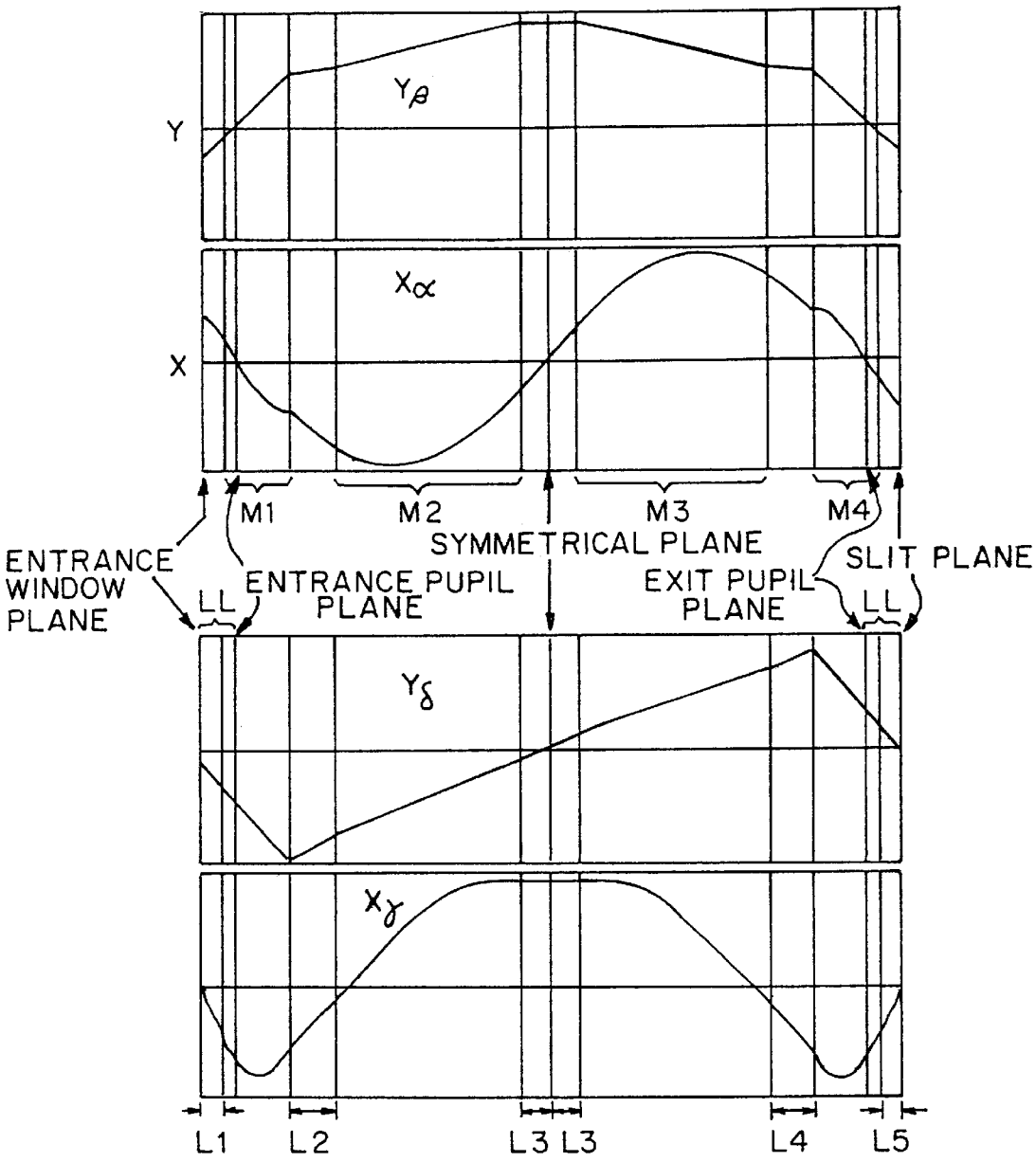
FIG. 14(A) PRIOR ART

In FIG. 8, a merit function M used to evaluate the performance of an energy filter is plotted against the angle of deflection Φ. The merit function is in proportion to the dispersion D and inverse proportion to aberration $\Delta X_s$. It can be observed that the merit function M begins to decrease at around 113°. In any case, the relation M>10 is satisfied. FIG. 9 is a graph showing an aberration sum $(B_{\alpha\beta\delta}+B_{\gamma\beta\beta}+C_{\gamma\delta})$ that is a measure of aberration on the exit pupil plane. At every angle, the aberration sum is less than 3500.

As can be understood from the description provided thus far, the present invention makes zero the length of drift spaces on opposite sides of the center plane (symmetrical plane) of a conventional four-magnetic field region OMEGA energy filter, thus forming a three-magnetic field region OMEGA energy filter. Therefore, aberrations are unaffected by the drift spaces and can be reduced. Hence, the filter can be miniaturized. The beam needs to be focused at four locations. However, there are only three magnetic polepiece end surfaces. Therefore, the number of parameters is fewer by one. This can be compensated, for example, by radii of curvature of the beam.

Having thus described my invention with the detail and particularity required by the Patent Laws, what is desired protected by Letters Patent is set forth in the following claims.

What is claimed is:

1. An OMEGA energy filter comprising:

electromagnets establishing three magnetic field regions to define a trajectory of an electron beam between an entrance window plane and a slit plate, said trajectory being continuously deflected into an omega-shaped form having a symmetrical plane perpendicular to a plane containing said trajectory of the electron beam; and said magnetic field regions arranged in turn from an incident side of the energy filter and having deflection angles of Φ, 2Φ, and Φ, respectively, said deflection angle Φ being set such that $102° < \Phi < 115°$.

2. The OMEGA energy filter of claim 1, wherein the beam shows a radius of curvature of R3 in the magnetic field region of the deflection angle 2Φ and a radius of curvature of R4 in the magnetic field regions of deflection angle Φ, and wherein the radius of curvature R3 is set less than the radius of curvature R4.

* * * * *

UNITED STATES PATENT AND TRADEMARK OFFICE

CERTIFICATE OF CORRECTION

PATENT NO. : 6,307,205 B1
DATED : October 23, 2001
INVENTOR(S) : Katsushige Tsuno It is certified that error appears in the above-identified patent and that said Letters Patent is hereby corrected as shown below:

Column 2,
Line 14, "Their different" should read -- Their difference --.

Column 3,
Line 12, "36°" should read -- 360° --.
Line 56, "less thank" should read -- less than --.

Column 4,
Line 20, "Cβδ" should read -- $C_{\beta\delta}$ --.
Line 23, "OMEGAI" should read -- OMEGA --.

Column 5,
Line 9, "fomanetic" should read -- four-magnetic --.
Line 57, "α and δ" should read -- β and δ -- .

Column 6,
Line 59, "ratio ($B_{\alpha\gamma\delta}$" should read -- ratio ($B_{\alpha\beta\delta}$ --.

Column 7,
Line 50, "present; invention" should read -- present invention --.

Column 8,
Line 7, "is noes" should read -- is now --.
Line 33 "$B_{\alpha\beta\beta}$" should read -- $B_{\alpha\beta\delta}$ --.

UNITED STATES PATENT AND TRADEMARK OFFICE

CERTIFICATE OF CORRECTION

PATENT NO. : 6,307,205 B1
DATED : October 23, 2001
INVENTOR(S) : Katsushige Tsuno It is certified that error appears in the above-identified patent and that said Letters Patent is hereby corrected as shown below:

Column 8,
Line 45, "$C_{\gamma\delta}$" should read -- $C_{\beta\delta}$ --.

Signed and Sealed this

Twenty-eighth Day of May, 2002

*Attest:*

*Attesting Officer*

JAMES E. ROGAN
*Director of the United States Patent and Trademark Office*